United States Patent [19]

Rozier

[11] Patent Number: 5,054,527

[45] Date of Patent: Oct. 8, 1991

[54] FILLER HEADS FOR PRESSURIZED BOTTLES

[75] Inventor: Alain Rozier, Calella de Palafrugell, Spain

[73] Assignee: Zona Industrial De Montras, Palafrugell, Spain

[21] Appl. No.: 575,176

[22] Filed: Aug. 30, 1990

Related U.S. Application Data

[63] Continuation of Ser. No. 325,670, Mar. 20, 1990, abandoned.

[30] Foreign Application Priority Data

Mar. 21, 1988 [ES] Spain ..... 8800857

[51] Int. Cl.[5] ..... B65B 31/00; B65B 43/42

[52] U.S. Cl. ..... 141/39; 141/147; 141/48

[58] Field of Search ..... 141/39, 40, 147, 6, 141/47, 48, 49, 52, 54

[56] References Cited

U.S. PATENT DOCUMENTS

| | | | |
|---|---|---|---|
| 3,209,794 | 10/1965 | Granier | 141/6 |
| 3,595,280 | 7/1971 | Fissel | 141/40 |
| 4,254,804 | 3/1981 | Wada et al. | 141/40 |
| 4,342,344 | 8/1982 | Ahlers | 141/39 |
| 4,386,635 | 6/1983 | Ahlers et al. | 141/6 |
| 4,398,575 | 8/1983 | Brandon | 141/39 |
| 4,589,453 | 5/1986 | Weiss | 141/39 |
| 4,949,764 | 8/1990 | Clüsserath | 141/39 |

*Primary Examiner*—Henry J. Recla
*Assistant Examiner*—Keith Kupferschmid
*Attorney, Agent, or Firm*—Zarley, McKee, Thomte, Voorhees & Sease

[57] ABSTRACT

The head is determined by a valvular body defined by a housing (4) inside of which there is a sealer bushing (5) of the annular discharge outlet (7), which is crossed through by a vertical tube (8) whose bottom end can penetrate into the bottle (1) to be filled. The bushing (5) is axially connected to another segmented one (11) which pressed on the tube (8) by means of peripheral elastic rings (13). Both bushings incorporate both elastic inside rings (14-15), one of the non-slip type (14), which adjusts into the cylindrical periphery of the tube (8). Between the annular bed joint (6) of the sealer bushing (5) and the discharge outlet (7) there are two radial ducts (16-17) one (17) of which is connected to a discharge valve and the other (16) bifurcates to connect to both pressure (18) and vacuum (19) units of temporary and alternate operation. The bottle is pushed along its base in order to adjust hermetically to the discharge outlet (7) provided with an elastic bushing (3).

3 Claims, 1 Drawing Sheet

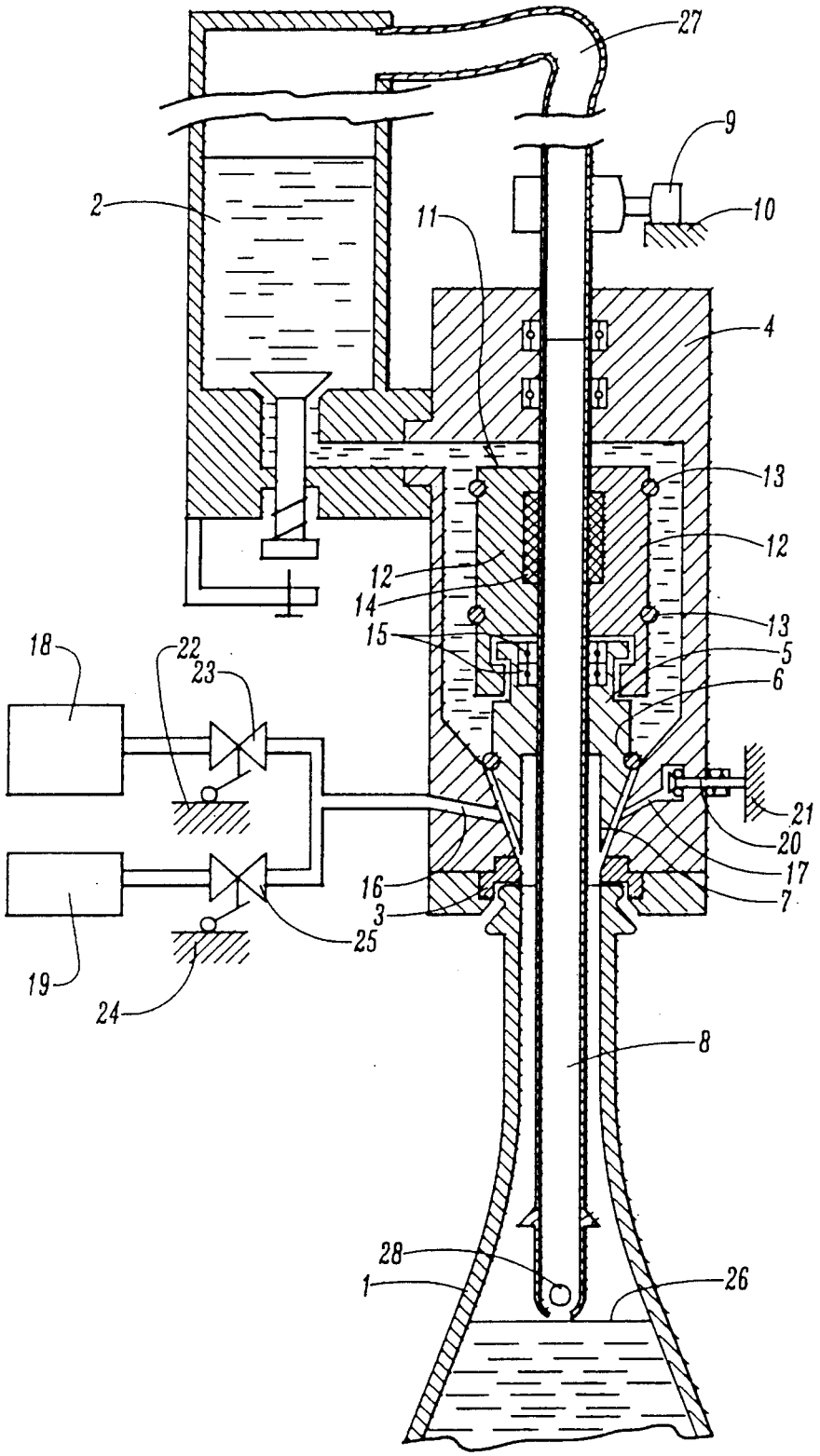
27
9
10
2
11
4
13
12
12
14
13
15
5
6
18
22
23
21
20
17
16
7
3
25
19
24
8
28
1
26

FILLER HEADS FOR PRESSURIZED BOTTLES

This is a continuation of application Ser. No. 07/325,670 filed Mar. 20, 1990, now abandoned.

As expressed in the title of this specification, the present invention refers to improvements in filler heads of pressurized bottles.

The filler heads of pressurized bottles on which the invention is centered are especially applicable to the bottling of carbonated drinks and are of the known form grouped or combined with others in a carrousel so that the bottles to be filled accede in sequence.

The present heads include in their filler mechanism parts liable to rust or react with the product and others requiring adjustments or periodic maintenance, such as springs, screws, valves, etc.

In accordance with the invention, all mechanisms which would be deteriorated by the passing of the product are eliminated from the circuit where the liquid circulates, given that the operation of the system is automatized by the balance of pressures and depends on that balance. With the filler head of the present invention, the pouring of the liquid is only possible in the presence of the bottle and in perfect conditions of adjustment of the mouth of the head with the neck of the bottle, since in the absence of the bottle, the opening of the flow valve of the filler head does not take place.

The liquid is contained in a tank shared by the whole carrousel, and the discharge outlet of each head has a valvular body or housing inside of which there is a closing bushing which is vertically displaceable and which has a leakproof bed annular joint surrounding the discharge outlet, advantageously like a truncated cone. This closing bushing is in turn mounted coaxially and outside the vertical tube whose bottom portion penetrates into the bottle to be filled and whose top portion remains flexibly connected to the tank.

The closing bushing is connected to the tube by means of flexible rings housed in respective annular grooves and are adjusted to the cylindrical periphery of the tube.

In the axial prolongation solidly connected to the closing bushing there is another bushing divided longitudinally in two or more sections which mutually engage each other and the tube via peripheral elastic rings.

The tube incorporates a feeler operated by a cam, through which its vertical displacement is attained.

Between the annular joint and the discharge outlet of the housing there is a pair of ducts, one of which is connected to the decompression valve, while the other bifurcates so that its branches are connected to the pressurized gas circuit and to the vacuum unit, of temporary and alternate operation.

The tank containing the liquid is subjected to pressure. The elevation of the closing bushing, which controls the flow of the liquid to the bottle, is adjusted when there is pressure inside the bottle higher than atmospheric pressure. Such adjustment is obtained by the opening of the valve in the pressure circuit.

Upon communicating pressure to the inside of the bottle to be filled, the closing bushing undergoes compression by both top and bottom surfaces, since at the top surface, the liquid communicated with the general tank exerts pressure, while at the bottom surface, the pressure of the gas contained in the bottle exerts pressure The pressures adjust in the discharge channels of the housing, provided for this purpose with a flexible annular bushing These pressures are balanced upon the tank and the bottle which communicate through the tube.

After the communication of pressure in the inside of the bottle to be filled, the fall and subsequent rise of the tube, established by the cam and feeler solidly connected to a free end thereof, determines the rise of the closing bushing and the filling of the bottle to the height marked by the end of the tube.

After the filling of the bottle and by means of the same cam, the tube falls and with it the closing bushing which cuts off the entry of the liquid. In this downward movement of the tube, its end submerges into the liquid in the bottle, and upon communicating an overpressure through the pressure circuit, this produces the return of the liquid situated above the outlet mouth of the tube through the tube itself and up to the tank containing the liquid.

Before proceeding to remove the bottle from the head, the pressure inside the bottle is eliminated by operating the decompression valve, thus, ending the filling operation.

To facilitate the understanding of the features of the invention and forming an integral part of this specification, we accompany a sheet of drawings in whose sole FIGURE, with an illustrative and non-restrictive nature, a longitudinal elevational section of the filler head of pressurized bottles has been represented, which provides the features of the invention, coupled to a bottle to be filled, partially shown.

Referring to the numbering that is indicated on the commented figure, we can see that the bottle 1 is filled from the tank 2 containing the liquid, this tank 2 being shared by the different heads which we have called the multiple carrousel. The neck of the bottle 1 adjusts hermetically against the flexible annular bushing 3 which defines the discharge outlet of the head.

Between the tank 2 and the discharge outlet, there is a valvular body or housing 4. Inside housing 4 is the closing bushing 5 which is displaceable and which holds the leakproof bed annular joint 6. The discharge channel 7, defined in the outlet mouth of the housing 4 has a truncated cone arrangement just like the lower end of the closing bushing 5. Said bushing is mounted on the vertical tube 8, whose bottom end penetrates into the bottle 1 to be filled and whose top end incorporates the feeler or follower 9 of the operating cam 10.

The closing bushing 5 is connected in turn and by its top end to another bushing 11 which is longitudinally divided into two or more segmented sections 12, mutually engaging each other and upon the periphery of the vertical tube 8, by means of elastic rings 13. These sections 12 form an annular groove where there is a relatively non-slip supplement 14.

The closing bushing 5 adjusts to the outer periphery of the tube 8 with flexible rings 15 located in an inner annular recess of the bushing.

Between the annular joint 6 and the discharge outlet defined by the flexible bushing 3 there are the ducts 16 and 17. The duct 16 temporarily and alternatively communicates with the pressure unit 18 and vacuum unit 19. The other duct 17 ends in the decompression valve 20.

The discharge channel 7 which ends in the mouth of bushing 3, closes against the neck of the bottle 1 to be filled, which is pushed towards the head by means of a rising platform upon which it rests.

The tank 2 of liquid is subjected to a certain pressure, with which the annular joint 6 of the closing bushing 5 prevents the emergence of liquid. The elevation of the bushing 5 allows the flow of liquid to the bottle 1. This rise of bushing 5 only happens when pressure has been communicated to the inside of the bottle 1, through said duct 16 in communication with the pressure unit 18.

When these pressures are balanced, the fall and subsequent rise of the tube by effect of the adjustable cam 10 determines the displacement of the closing bushing 5 for the filling of the bottle 1 up to the bottom end of the tube 8. In other words, bushing 5 raises and lowers together with tube 8 when the pressure in bottle 1 and tank 2 are substantially equal.

Once the bottle has been filled, the cam 10 forces the tube 8 to effect a downward movement pulling the closing bushing 5 to seal the discharge channel 7. In this movement, the bottom end of the tube 8 submerges into the liquid to a certain height and upon communicating an overpressure to the inside of the bottle 1, by means of the pressure unit 18, the liquid situated above the bottom mouth of the tube 8 returns to the tank 2 through the tube itself 8 which incorporates the unidirectional valve 8.

Before removing the bottle 1, the discharge of the inside pressure takes place upon operating the decompression valve 20, thus ending the filling operation.

The eventual loss of pressure in the inside of the bottle 1 establishes the automatic closing of the bushing 5 due to decompensation of pressures between the top and bottom thereof.

With the functional features which the invention furnishes, the process of filling the bottle 1 begins with the arrival of the bottle to a platform which rises so that the neck of the bottle is hermetically applied against the flexible bushing 3.

Afterwards, by means of the vacuum unit 19 and by activation of the valve 25 by means of the cam 24, the air contained in the bottle 1 to be filled is removed. This operation is optional, in terms of the features of the liquid to fill the bottle and this is done when the air may someway be detrimental.

Then, by means of the unit 18, pressurized with gas such as carbon dioxide or the like, a pressure is transmitted to the inside of the bottle 1 which is balanced with the pressure existing in the tank 2.

Afterwards, by means of the cam 10, the tube 8 descends, introducing itself into the bottle 1; after which it rises some 5 mm. by action of this same cam 10. Due to the balance of pressures obtained on both sides of the leakproof bed annular joint, the closing bushing 5 does not offer any resistance upon rising, so said rise of the tube 8 is transmitted to the bushing 5 and the annular joint 6 is separated with regard to the discharge channel 7, thus permitting the flow of liquid towards the bottle The elevation of the closing bushing is ensured by the rubbing caused by the flexible rings 15 and advantageously increased by the silicone supplement 14, or by the pressure that the sections 12 of the bushing 11 exert due to the effect of the stress of the elastic rings 13.

Once the closing bushing 5 is open, the liquid coming from the tank 2 flows towards the bottle 1 and the gas contained in the same returns to the tank 2 through the tube 8 and the duct 27. The filling of the bottle is effected until the liquid reaches the bottom mouth of the tube 8, after which the entry of liquid ceases due to the fact that the gas can no longer escape through the tube 8.

The adjustment of the filling level 26 is obtained afterwards, lowering the tube 8 to the corresponding height, introducing its mouth into the liquid and simultaneously determining the fall of the closing bushing with the subsequent closing of the flow of liquid to the bottle. Then, through the duct and by means of the operation of the valve 23 directed by the cam 22, the pressurized unit 18 injects gas at a pressure slightly higher than the filling pressure, determining the expulsion of the excess liquid, exactly to the level 26 where the bottom mouth of the tube 8 remains, as explained above.

The level 26 of filling of the bottle 1 is adjustable from the outside, even with the machine in operation, which is determined by the run of the cam 10 which is adjustable.

Once the bottle 1 has been filled, by means of the outer cam 21 the decompression valve 20 is operated, which eliminates the gas pressure existing inside the bottle, after which the tube 8 is raised until situating its bottom mouth above the discharge outlet 7 of the head and the bottle 1 is removed by means of the fall of the platform that held it pressed against the elastic bushing 3, thus ending the filling cycle. After the filling operation is completed, the pressure within tank 2, which is greater than the relieved pressure within bottle 1, prevents bushing 5 from rising as tube 8 rises.

When in the filling cycle, if the bottle 1 breaks or does not adjust perfectly in the flexible annular bushing 3, the closing bushing 5 remains closed or immediately closes, due to the decreased pressure in the bottle relative to the pressure in tank 2, if the liquid was flowing from the tank to the bottle 1. With this feature, only in the presence of the bottle and in perfect conditions of adjustment will the pouring of the liquid take place.

I claim:

1. An improved filler head for pressurized bottles, said filler head being operatively connected to a tank having liquid for filling the bottles, and being operatively connected to a pressure source, the improvement comprising:

a body remote from the tank having a passageway therein with an inlet in communication with said tank and an outlet adapted to be positioned over a bottle so as to fill the bottle with liquid from the tank;

a tube extending through the body and having a lower end extensible into a bottle and an upper end communicating with said tank for venting gases from said bottle, the tube being remote from the tank;

a closing bushing slidably mounted on said tube and within the body, said bushing being movable between a lowered closed position sealingly blocking the passageway between the inlet and outlet thereof and a raised open position unblocking the passageway; and a cam operatively connected to the tube for raising and lowering the tube, and thus the closing bushing, whereby the tube vents gases from the bottle when the liquid level in the bottle is below the lower end of the tube and whereby the tube is capable of expelling excess liquid residing above the lower end of the tube.

2. The filler head of claim 1 further comprising flexible rings mounted in the closing bushing and having sliding and sealing engagement with the tube.

3. The filler head of claim 1 further comprising a first duct in the body for providing selective communication between the outlet and a source of pressure remote from the tank for pressurizing the bottle and a source of vacuum remote from the tank for evacuating air from the bottle prior to filling with liquid, and a second duct in the body having a decompression valve for providing communication between the outlet and the atmosphere.

* * * * *

UNITED STATES PATENT AND TRADEMARK OFFICE

CERTIFICATE OF CORRECTION

PATENT NO. : 5,054,527

DATED : October 8, 1991

INVENTOR(S) : Rozier

It is certified that error appears in the above—identified patent and that said Letters Patent is hereby corrected as shown below:

On title page, item [73] Assignee, change "Zona Industrial De Montras, Palafrugell, Spain"

to

--Perrier Iberica, S.A., Palafrugell, Spain--

Signed and Sealed this

Seventh Day of December, 1993

Bruce Lehman

*Attest:*

BRUCE LEHMAN

*Attesting Officer*

*Commissioner of Patents and Trademarks*